US005398609A

United States Patent [19]

Stiel

[11] Patent Number: 5,398,609

[45] Date of Patent: Mar. 21, 1995

[54] DEVICE FOR TENSIONING AND ADJUSTING FLEXIBLE PRINTING PLATES ON PLATE CYLINDERS OF ROTARY PRESSES

[75] Inventor: Jürgen A. Stiel, Ostheim, Germany

[73] Assignee: Koenig & Bauer Aktiengesellschaft, Wurzburg, Germany

[21] Appl. No.: 196,118

[22] PCT Filed: Aug. 14, 1992

[86] PCT No.: PCT/DE92/00684

§ 371 Date: Jun. 9, 1994

§ 102(e) Date: Jun. 9, 1994

[87] PCT Pub. No.: WO93/03925

PCT Pub. Date: Mar. 4, 1993

[30] Foreign Application Priority Data

Aug. 16, 1991 [DE] Germany ..... 41 27 232.3
Aug. 12, 1992 [DE] Germany ..... 42 26 565.7

[51] Int. Cl.[6] ..... B41F 29/04
[52] U.S. Cl. ..... 101/415.1
[58] Field of Search ..... 101/415.1, 409, 410

[56] References Cited

U.S. PATENT DOCUMENTS

| | | | |
|---|---|---|---|
| 2,578,406 | 12/1951 | Dutro | 101/415.1 |
| 2,837,025 | 6/1958 | Pechy | 101/415.1 |
| 2,946,282 | 7/1960 | Harless | 101/415.1 |
| 3,119,331 | 1/1964 | Koch et al. | 101/415.1 |
| 3,795,193 | 3/1974 | Johne et al. | 101/415.1 |
| 4,688,484 | 8/1987 | Herold et al. | 101/415.1 |
| 4,712,476 | 12/1987 | Jeschke | 101/415.1 |
| 4,785,736 | 11/1988 | Jeschke | 101/415.1 |
| 4,840,121 | 6/1989 | Szczesniak | 101/415.1 |
| 4,938,135 | 7/1990 | Wieland | 101/415.1 |
| 5,016,531 | 5/1991 | Schroeder | 101/415.1 |
| 5,097,763 | 3/1992 | Simeth | 101/415.1 |
| 5,189,958 | 3/1993 | Tafel et al. | 101/415.1 |

FOREIGN PATENT DOCUMENTS

| | | |
|---|---|---|
| 0201747 | 4/1986 | European Pat. Off. . |
| 87049 | 1/1972 | German Dem. Rep. . |
| 2935699 | 3/1981 | Germany . |
| 3604071 | 1/1990 | Germany . |
| 4137948 | 5/1992 | Germany . |

OTHER PUBLICATIONS

MESA Technical Brochure-Oct. 21, 1991.

*Primary Examiner*—Eugene H. Eickholt
*Attorney, Agent, or Firm*—Jones, Tullar & Cooper

[57] ABSTRACT

A device for tensioning and adjusting flexible printing plates on plate cylinders of rotary printing presses, has as an object to achieve an automatic tensioning and a partial adjustment of the printing plates, in which the width of the cylinder groove as well as the transmission losses are kept low. According to the invention, this object is solved by that the pressure bar is movable in the radial direction via adjustment means, causing a tensioning- and adjustment movement of the printing plate tensioning bar via wedge areas on a secant, intersecting the cylinder groove at an angle of about 90°.

11 Claims, 7 Drawing Sheets

DEVICE FOR TENSIONING AND ADJUSTING FLEXIBLE PRINTING PLATES ON PLATE CYLINDERS OF ROTARY PRESSES

FIELD OF THE INVENTION

The invention relates to a device for tensioning and adjusting flexible printing plates on plate cylinders of rotary presses.

THE PRIOR ART

In sheet-fed rotary presses, there are made efforts to shorten the set-up times and auxiliary times, with increasing the printing quality at the same time. In this connection, it is important to clamp and to adjust the flexible printing plates within a short time.

According to the German patent document DE 29 35 699 A1, there is known a device for a register-true tensioning of printing plates in printing presses, at which a tensioning bar has mirror-invertedly arranged wedge-levels. There can be thrown-on against these wedge-levels, sliding wedge-levels of sliding blocks, arranged on an adjustment spindle having a thread with an opposed direction, so that the tensioning bar is tensioned parallely to the cylinder axis.

A disadvantage of this device is, that the groove itself has to have a certain width, simply for receiving the adjustment elements, acting in the plate tensioning direction.

A further disadvantage is, that a plurality of lever arrangements are used and an adjustment of the printing plate is not possible, in consequence of a parallel guiding of lazy tongs.

SUMMARY OF THE INVENTION

It is the object of the invention, to provide a device for a remote tensioning and a remote one-piece adjustment of flexible printing plates on plate cylinders of sheet-fed rotary presses, in which the space requirement for the device for the generation of the force for the tensioning movement is small.

By the invention, especially the following advantages are achieved. By the arrangement of especially two drives, it has become possible, to tension and to adjust the printing plate by the simple linear deflection of one printing plate end. A swivelling or diagonal adjustment, as well, of the printing plate, is possible, when the second quick-acting tensioning device for holding and tensioning the leading printing plate edge is equipped with a drive according to the invention. In this connection, there do not occur any bending moments in parts, which require an overdimensioning and thus have a high space requirement. The forces are transmitted via the wedge-areas by means of pressure. The points of introduction of force are situated near the circumference of the cylinder, which avoids greater lever transmissions.

BRIEF DESCRIPTION OF THE DRAWINGS

The invention is to be described at several embodiments.

The accompanying drawings show in

According to FIG. 1, there is shown a longitudinal cut through the groove of the plate cylinder with the device according to the invention. The cut extends along the line I—I according to FIG. 4. The associated FIG. 1 shows this cut. The shown parts according to FIG. 4 exist in mirror-inverted form two times for each cylinder. This is clarified by a vertically extending center line 37. The plate cylinder 1 has at its surface an axially extending cylinder groove 2; 3, each of them limited in its length by the front sides 4; 6 of the plate cylinder 1 and by plinths 7; 8. Between the plinths 7; 8, there is arranged a channel groove 9, which is situated lower in relation to the cylinder grooves 2; 3, for receiving the drive of the device. The plinth 7 ends in a slant 11, extending in the direction of the channel groove 9, whereas an area 12 of the plinth 8 extends horizontally. A pressure bar 13, extending in the axial direction, is arranged in a recess between the upper cylinder gap side wall 14 and the lower cylinder gap side wall 16. The pressure bar 13 has on its side, directing to the channel groove 9, two wedge-shaped shoulders 17; 18, which are in direct effective contact with the slant 11 of the plinth 7 and in indirect effective contact with the horizontal area 12 of the plinth 8. The slant 11 extends at an angle $\alpha$ in relation to the horizontal, corresponding to the angle $\alpha$ of the wedge-shaped shoulder 17. The amount of the angle can be between 5° and 30°.

Figure 1:
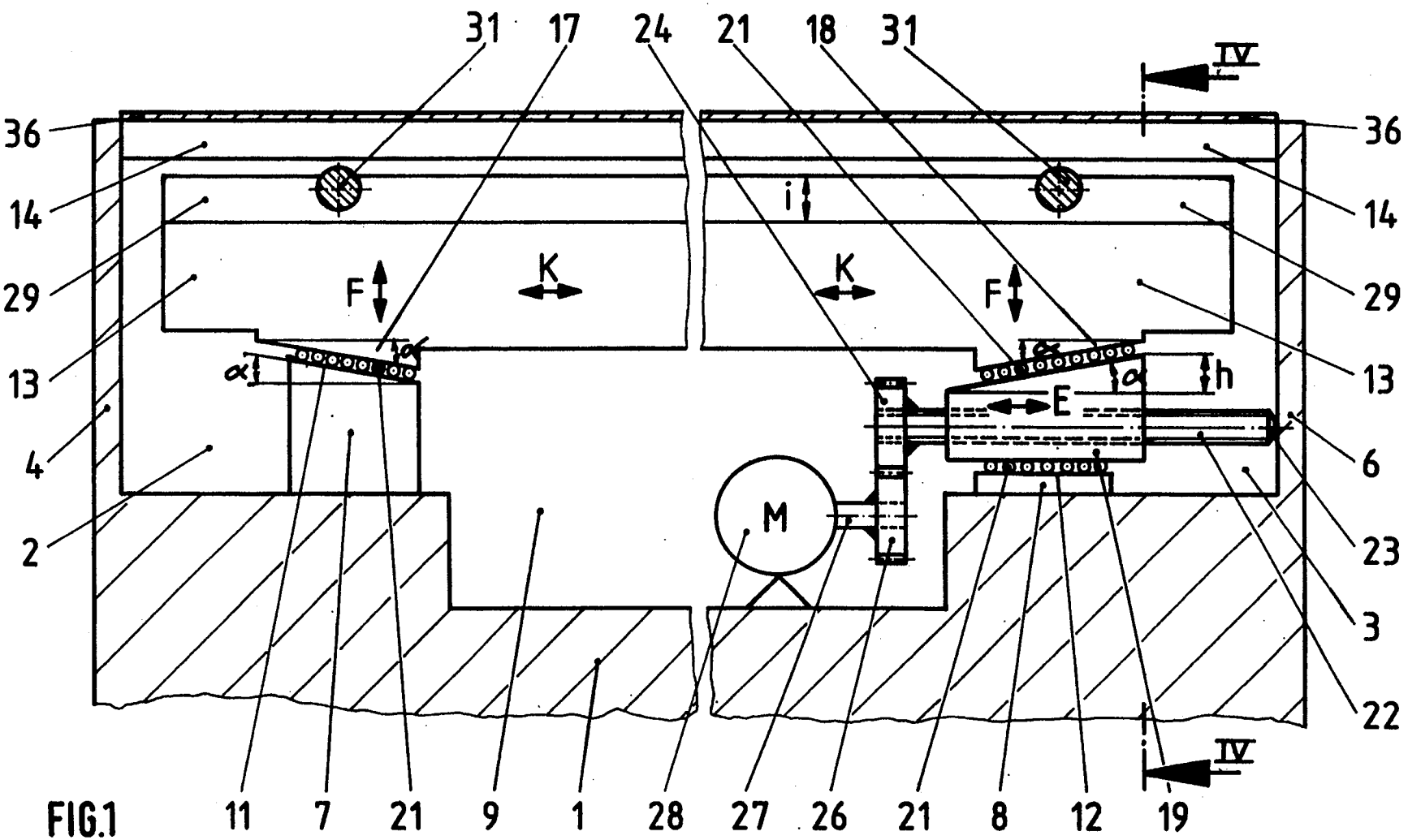
FIG. 1 a longitudinal cut through the groove of the plate cylinder with the device according to the invention, FIG. 2 a second embodiment according to the representation according to FIG. 1, FIG. 3 a third embodiment, FIG. 4 the cut IV—IV according to FIG. 1, FIG. 5 a second embodiment of the pressure bar, FIG. 6 to 9 further embodiments of drives according to FIG. 3 for the generation of a radial movement of the pressure bar.

Between the horizontally extending area 12 of the plinth 8 and between the inclined plane 18, being situated at the pressure bar 13, there is arranged a one-sided executed first wedge 19.

At the areas, which are in effective contact with each other, there can be arranged for the reduction of the friction, flat needle cages 21. The angle $\alpha$ of the wedge-shaped shoulder 18 corresponds in this connection to the angle $\alpha$ of the wedge 19. The wedge 19 has a tap hole in the axial direction, and is shiftable on a thread spindle 22 in the direction E which is parallel to the axis, as the thread spindle 22 is on one side supported over a stop 23 at the front side 6 of the plate cylinder 1 and is on the other side connected fixed for rotation with a gear 24. The gear 24 meshes with a gear 26, which is in connection itself fixed for rotation via a shaft 27 with a motor 28. The motor 28 is fixed on the channel groove 9. The bearing location of the gears 24; 26 was not shown in the drawing, for reasons of simplification. The pressure bar 13 has on its side, directing away from the cylinder gap side wall 16, a slant 29, starting approximately from the last third of its end, being situated far away from the groove, the slant 29 extending in the direction of the upper cylinder gap side wall 14 and being in effective contact with a projection 31, e.g. a calotte-shaped end 31 or a counterslant of an adjustment screw 32. On the tensioning bar 33, there is arranged a known clamping bar 34 of a quick-acting tensioning device. Between the tensioning bar 33 and the clamping bar 34, there is hold a printing plate 36. The tensioning bar 33 is supported with its side, directing to the center line 37, by means of springs 38 at a parting plate 39, extending parallely to the center line 37. The center line 37 extends through the axis of rotation 35 of the plate cylinder 1.

The device according to FIG. 1 and 4 works as follows. A printing plate 36 is held in a clamping device, not shown in FIG. 4, but which is mirror-invertedly arranged on the other side of the center line 37, and is brought onto the peripheral surface of the plate cylinder 1 and is clamped between the tensioning bar 33 and the clamping bar 34 by a mechanism, not described in more detail, but known e.g. according to the German patent document DE 36 04 071 C2. The motor 28, executed as a DC-current motor with torque limitation and positioning device, drives via the gear 27; 26; 24; 22; 23; 6 the wedge 19, provided with an inside screw thread, which is movable according to the direction of rotation of the motor 28 in the direction E, parallel to the axis. In consequence of the effective contact, resulting from the wedge 19 and from the wedge-shaped shoulder 18, arranged at the pressure bar 13 as well as by the effective contact, resulting from the slant 11 of the plinth 7 and of the wedge-shaped shoulder 17, the pressure bar 13 experiences an up- and down movement in the radial or nearly radial direction F, maximally through a path having a length h. The pressure bar 13 is pressed over its slant 29 against the calotte-shaped end 31 of the adjustment screw 32. By this, there is effected a movement of the tensioning bar 33 in the direction of a secant 45 to the plate cylinder 1, which intersects the cylinder groove 2; 3. The secant 45 has a course at an angle $\beta$ to the radially movable pressure bar 13. The angle $\beta$ is preferably 90°, but can be between 45° and 95°. The secant 45 extends in the upper third of the total depth of the cylinder groove 2; 3. The printing plate 36 is there by tensioned. During tensioning of the printing plate 36, there is not only effected a radial movement of the pressure bar 13, but a compensating axial movement in the direction K, until the preset current input of the motor 28 is attained and the motor 28 switches off. The paths h; i, which have to be maximally travelled, of the wedge areas 17; 18 and 29 of the pressure bar 13 can be equal. The force is transmitted directly without bending moment as pressure force onto the tensioning bar 33. The introduction of force is effected not far away from the printing plate 36, nearly at the upper cylinder gap side wall 14. As motor 28, a pneumatic motor can be used as well.

The reset is effected in consequence of the reversal of the direction of rotation of the motor 28 and is facilitated by the effect of the springs 38. For the device according to FIG. 1, there are only small requirements concerning the manufacturing tolerances; a simple drive is needed. In case of using an electrical motor 28, the drive energy, commands and impulses are transmitted contactlessly into the rotating cylinder 1.

This happens in that way, by that at a front side of the plate cylinder 1, there is arranged a secondary coil a secondary electronic concentrically to the axis of rotation 35, which is cooperating with a primary coil, slightly spaced from the same, arranged fixed, and concentrically to the axis of rotation 35, which is in connection itself with a primary electronic, arranged at a distance from the same.

By this arrangement, electrical motors, each having 40 W, can be supplied with current. In addition, there is transmitted a data flow for inquiring the sensors or for activating motors. Consequently, there is provided a stable DC-current supply for the motors, arranged in the cylinder 1, independent from the angle of rotation at a certain moment. Such a contactless system of transmittal of power is offered e.g. by the company Mesa, system engineering GmbH in Constance.

Figure 2:
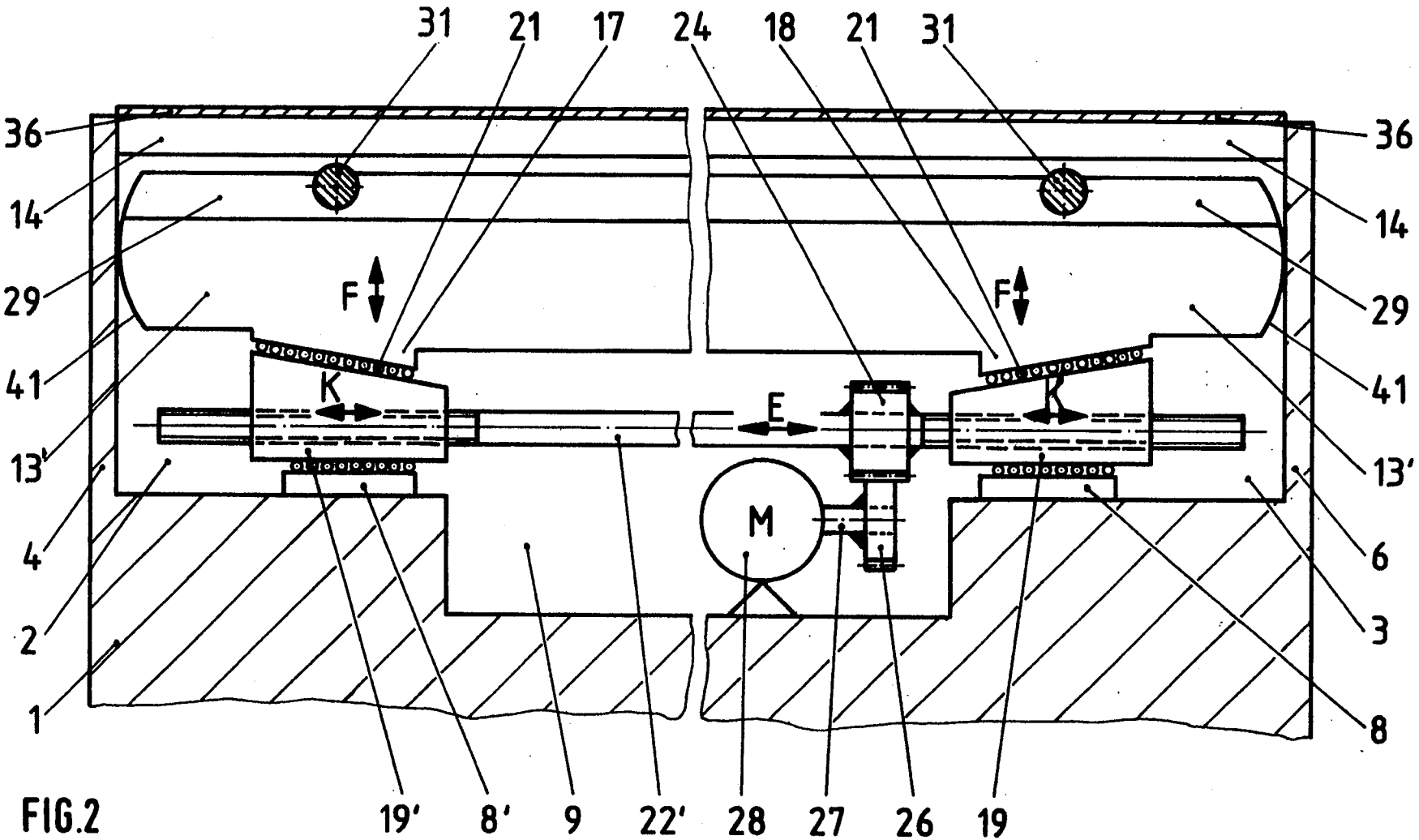

In FIG. 2, there is shown a second embodiment of the device. The differences of this embodiment to the one according to FIG. 1 consist in that there is provided a second, one-sided executed wedge 19', which rests against a plinth 8' having a horizontal area. A thread spindle 22' is supported over-mounted, provided with a thread having an opposed direction and connects the wedges 19; 19' with each other. A pressure bar 13' is different from the pressure bar 13 according to FIG. 1 by that the pressure bar 13' has at its both ends, directing to the front sides 4; 6 of the plate cylinder 1, curvatures 41, which are in effective punctual contact with the front sides 4; 6.

By this arrangement of a passing thread spindle with two bearing parts, is has become possible to have the drive effected from both sides.

Figure 3:
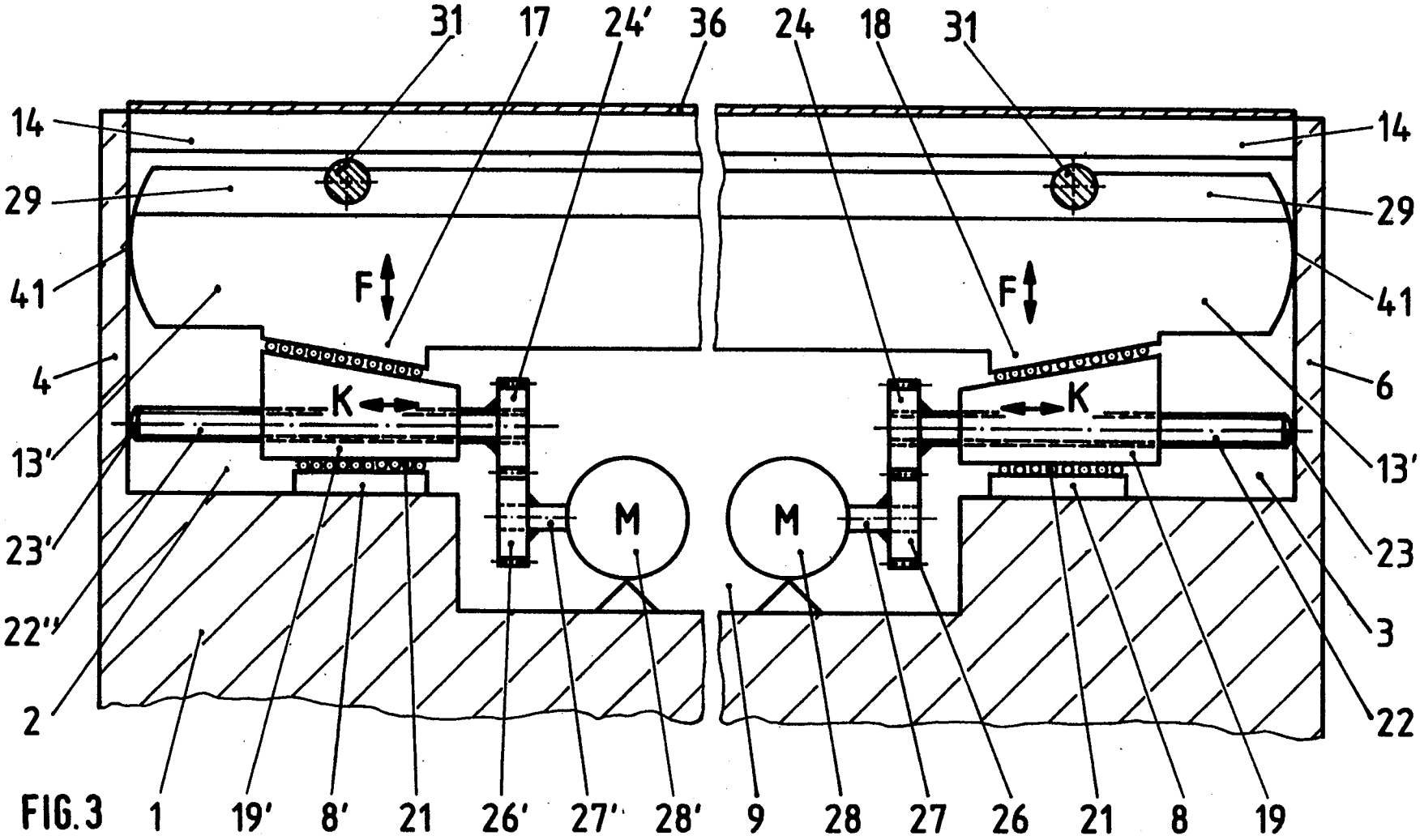

In FIG. 3, there is shown a third embodiment of the device for tensioning and adjusting flexible printing plates. The differences of this embodiment to the one according to FIG. 1 consist in that there is provided a second drive 28'; 27'; 26'; 24'; 22''; 23', which is arranged mirror-inverted in relation to the one, shown in FIG. 1. Consequently, there is also needed a second wedge 19', which rests on a plinth 8' having a horizontal area. The pressure bar 13' is executed at its ends, directing to the front sides 4; 6 of the plate cylinder 1, as well with curvatures 41.

By this arrangement with two separate drives, it is possible to operate the motors at first parallely for tensioning and compensating the printing plate and to make a following adjustment by admitting e.g. a motor with a nominal value.

Figure 5:
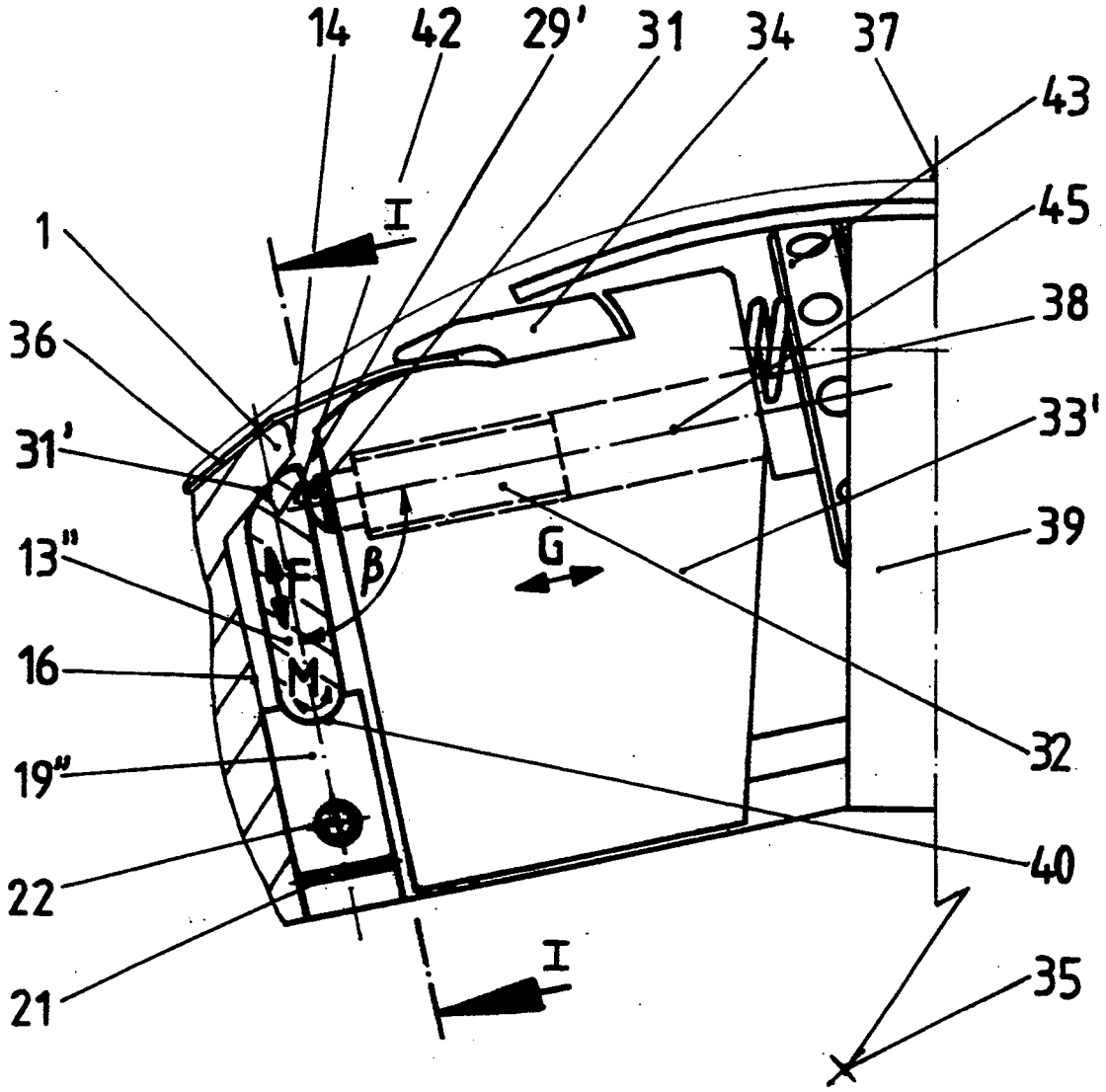

According to FIG. 5, there is shown a second embodiment of a pressure bar 13''. The pressure bar 13'' has a semicircular bearing area 40, facing downwardly toward the channel groove 9 and being supported on a third, one-sided executed wedge 19'', which accordingly has a groove, having a semicircular cross section. The upwardly or radially outwardly facing side opposing the mentioned side of the pressure bar 13'', has at its end a slant 29', extending from the side, being far away from the cylinder gap side wall, to the lower cylinder gap side wall 16 and approximately corresponds to the path i. This slant 29' is in effective contact with an opposing slant 31' and extends between the upper and lower cylinder gap side wall 14; 16 and extends approximately parallely to the periphery of the plate cylinder 1.

The function is as follows. The drive with one or several motors 28 according to FIG. 1 to 3 is switched on and the wedge 19'' is caused to move. The pressure bar 13'' experiences a radial movement in the direction F and comes in connection with the slant 29' to the slant 31' of the cylinder gap side wall. Simultaneously, in point 42, the pressure bar 13'' comes in effective contact with the tensioning bar 33', moving in the tensioning direction of the printing plate 36. The bearing area 40, having a semicircular cross section, of the pressure bar 13'', in this connection performs a slight movement in its bearing seat in the direction M.

Figure 4:
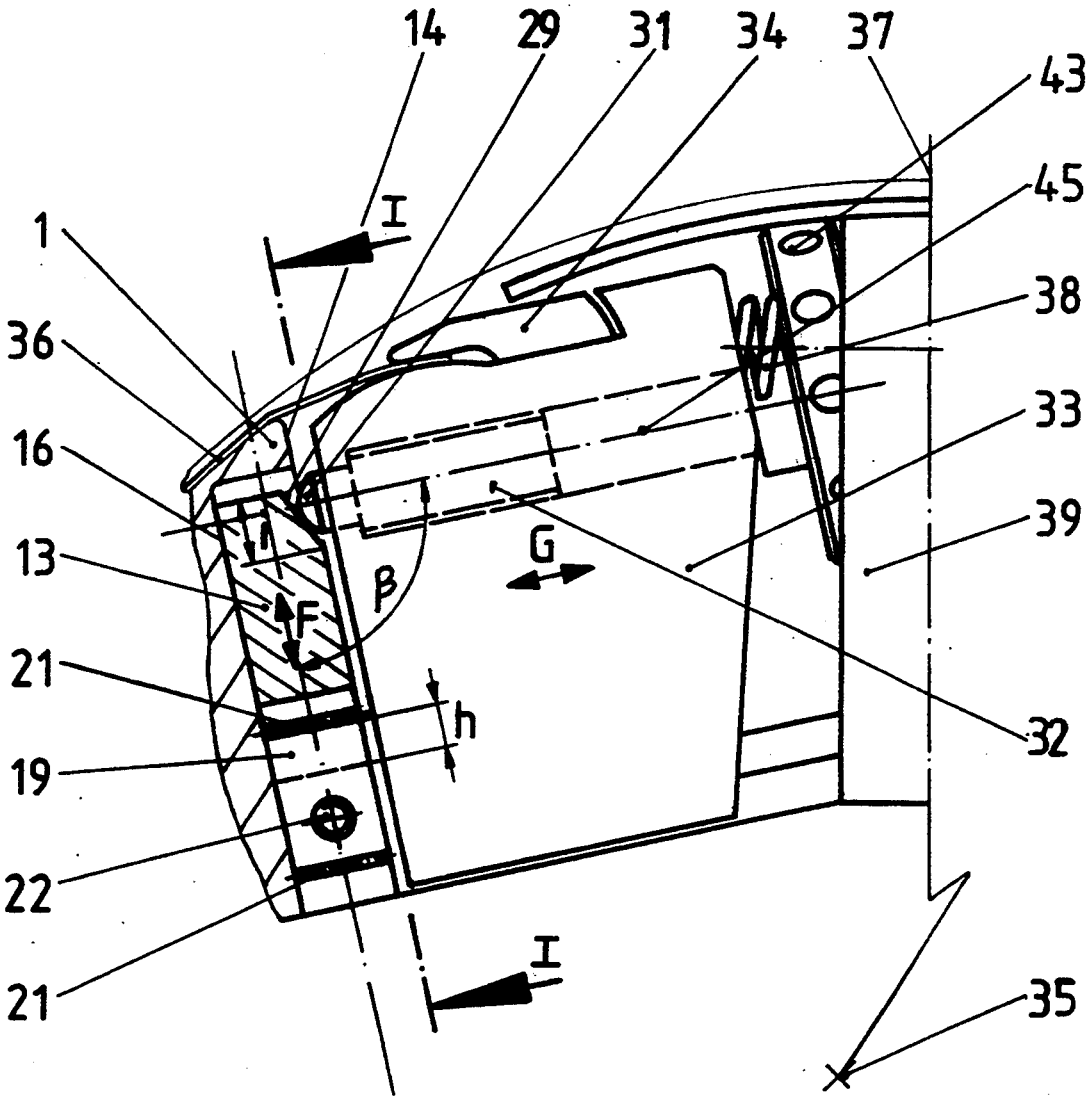

This embodiment can be used alternately to the one shown in FIG. 4. The adjustment screws 32 can be arranged in the axial direction in the same way as the springs 38, several times, e.g. four times, adjacent each other. The adjustment screws 32 serve for the fine adjustment of the printing plate tensioning and are adjustable via adjustment bodies 43. The adjustment bodies 43 are rigidly connected with the adjustment screws 32 and can be moved at their circumference by means of a cylindrical body, e.g. a pin, which has to be introduced into the same in the radial direction. This is advantageous especially at the embodiment, shown in FIG. 3, by means of two separate drives over motors 28; 28'.

In FIG. 6 to 9, there are shown alternate embodiments to the drives according to FIG. 3, for the generation of a radial movement F of the pressure bar 13'. According to the representation in FIG. 6, the pressure bar "13'" is moved directly in the radial direction F via a motor 28', arranged in the channel groove 9 and by a drive 24'; 26'; 27', connected with a thread spindle 52, by that the thread spindle 52 with the gear 24', rigidly arranged on the same, is rotatable in a tap hole 44, arranged in the radial direction F in the cylinder groove 2.

Figure 7:
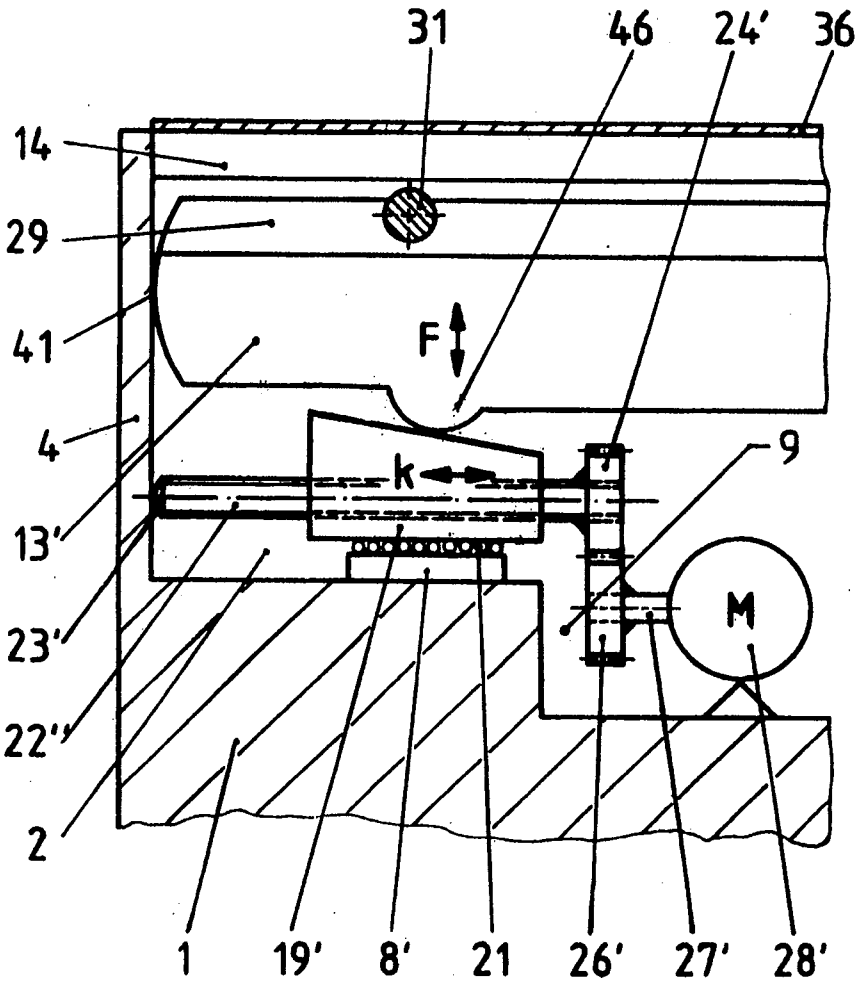
Figure 6:
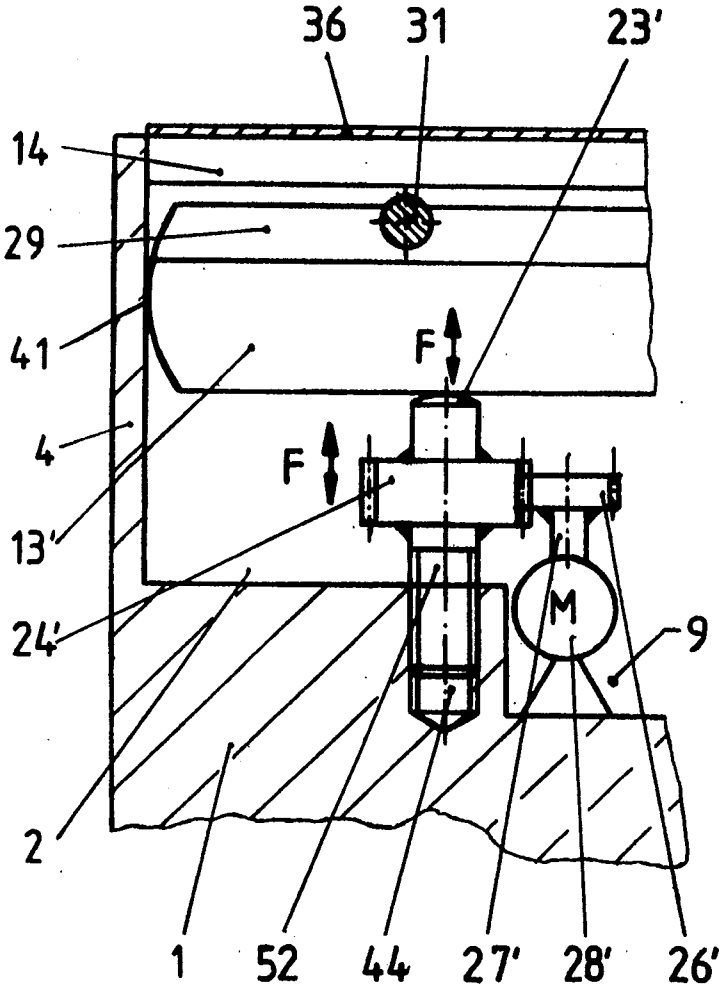

According to the representation in FIG. 7, the drive is provided, as in FIG. 3, with the particularity, that the pressure bar 13' has at its side, directing to the bottom of the cylinder groove 2, a nose 46, cooperating with the one-sided wedge-area of the wedge 19'.

Figure 8:
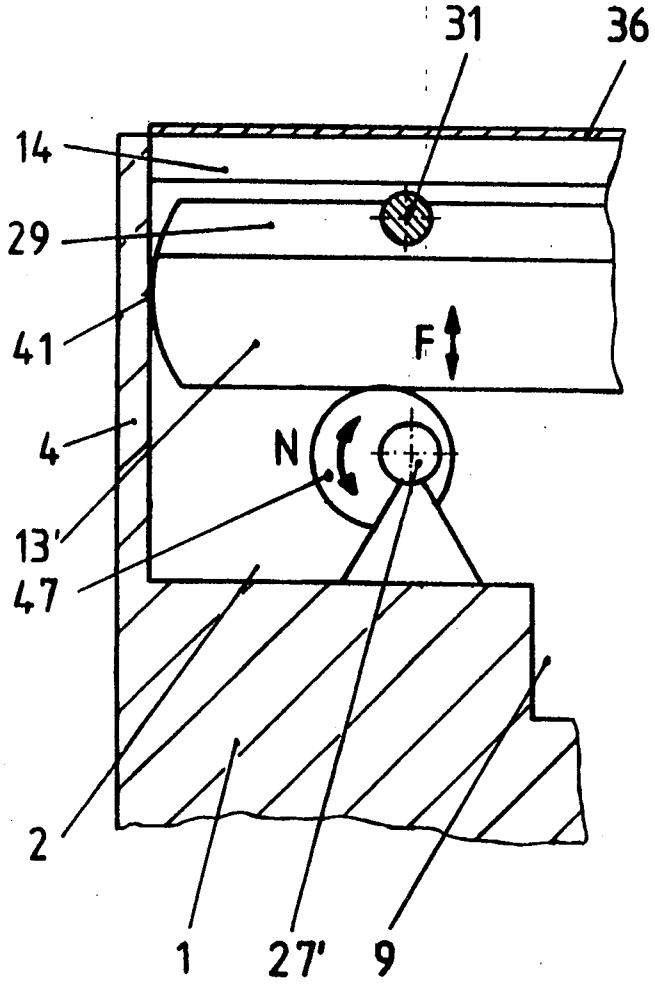

According to FIG. 8, there is shown a shaft 27', on which there is fixedly arranged an eccentric disk 47 and which effects in consequence of its rotation in the direction N, the movement of the pressure bar 13' in the radial direction F with the particularity, that the direction of rotation of the eccentric disk 47 is effected in the right angle to the direction of rotation of the plate cylinder 1.

Figure 9:
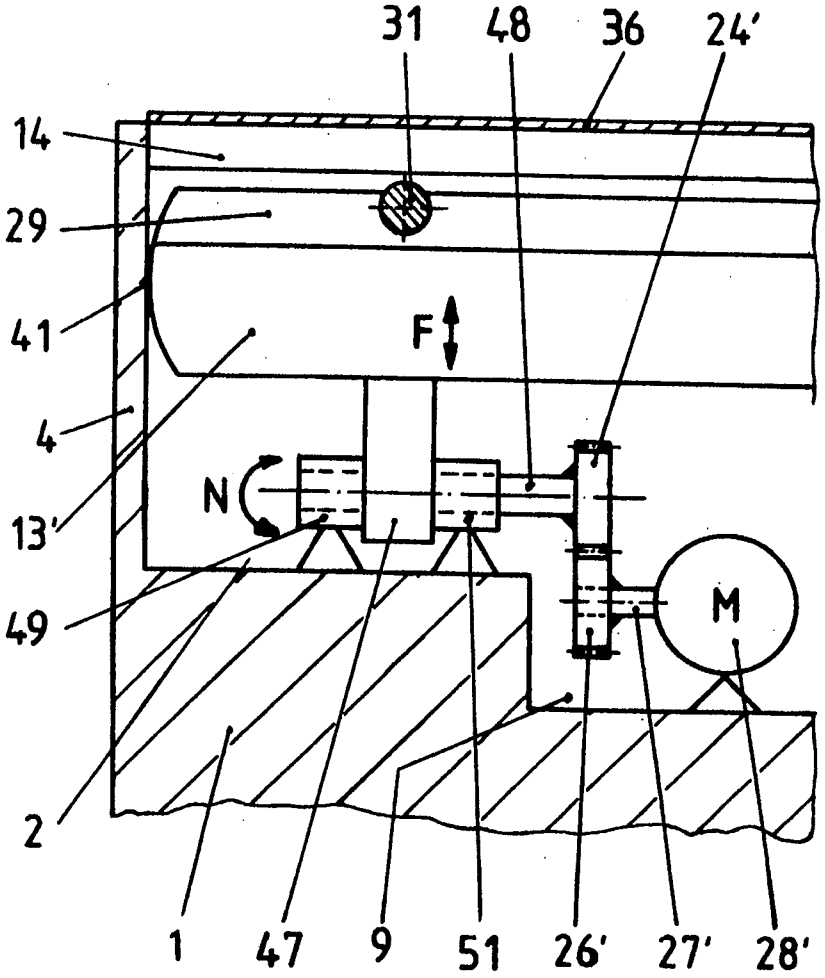

According to FIG. 9, there is arranged a motor 28' in the channel groove 9, which is connected via a shaft 27', and gears 26', 24' with a spindle 48, on which an eccentric disk 47 is arranged fixed for rotation. The spindle 48 is supported on both sides of the eccentric disk 47 on the bottom of the cylinder groove 2 via bearing bushings 49; 51.

I claim:

1. Device for tensioning flexible printing plates on plate cylinders of rotary presses with a clamping- and tensioning bar, acting nearly tangentially in relation to a peripheral surface of the plate cylinder, arranged in a groove, extending parallely to an axis of the plate cylinder, and gripping the printing plate ends, characterized by the improvement that there is arranged a pressure bar, extending in the axial direction, which is movable in the radial direction at its one end, directing to an axis of rotation of said plate cylinder, by adjustment means arranged in said cylinder groove, said pressure bar being in effective contact with a tensioning bar through a slant, said tensioning bar having projections, on a secant, having a course by an angle ($\beta$) in relation to the radial direction of movement, and which intersects said cylinder groove, so that said tensioning bar performs a tensioning movement and an adjustment movement.

2. Device according to claim 1 wherein said secant has its course in the upper third of the whole depth of said cylinder groove, being situated adjacent the periphery of said plate cylinder.

3. Device according to claim 1 wherein said angle ($\beta$) between said pressure bar, movable in the radial direction and the secant, having its course in plate tensioning direction, is between 45° and 95°.

4. Device according to claim 1 wherein said projections are executed as calotte-shaped ends of adjustment screws of a tensioning bar.

5. Device according to claim 1 wherein said projections are executed as counter-areas, arranged on said tensioning bar.

6. Device according to claim 1 wherein said adjustment means, arranged in said cylinder groove for generating the radial direction of movement to said lower end of said pressure bar directing to said cylinder groove, is an eccentric disk.

7. Device according to claim 1 wherein said adjustment means, arranged in said cylinder groove for generating the radial direction of movement to the lower end of said pressure bar directing to said channel groove are executed as wedge-shaped shoulders arranged on said pressure bar and extending by an angle ($\alpha$) in relation to the horizontal, which are movable against a counterslant extending by the angle ($\alpha$) by drives.

8. Device according to claim 1 wherein said adjustment means, acting upon said lower end, directing to said channel groove, consist of at least one drive.

9. Device according to claim 1 wherein said adjustment means, arranged in said cylinder groove for generating the radial direction of movement to the lower end of said pressure bar directed to said channel groove are executed as wedge-shaped shoulders arranged on said pressure bar and extending by an angle ($\alpha$) in relation to the horizontal which are movable against one-sided counterwedges which are shiftable in the direction parallel to the axis of the plate cylinder by drive means.

10. Device according to claim 1 wherein said adjustment means, arranged in said cylinder groove for generating the radial direction of movement to said lower end of said pressure bar directing to said cylinder groove is an adjustment spindle.

11. Device for tensioning flexible printing plates on plate cylinders of rotary presses with a clamping- and tensioning bar,acting nearly tangentially in relation to the peripheral surface of the cylinder, arranged in a groove, extending parallely to the axis, and gripping the printing plate ends, characterized by the improvement that a pressure bar extending at an axial direction of the plate cylinder, is movable at its one end, directing to an axis of rotation, by adjustment means arranged in said cylinder groove, at first in the radial direction, that said pressure bar is cooperating with a slant, situated at its second end, directing to said periphery, at a counterslant, extending between an upper and a lower cylinder gap side wall whereby said pressure bar performs a small swivelling movement in the direction of a secant extending by an angle ($\beta$) in relation to the radial direction of movement, which intersects said cylinder groove so that said tensioning bar generates a tensioning- and adjustment movement.

* * * * *